US005913716A

United States Patent [19]

Mucci et al.

[11] Patent Number: 5,913,716

[45] Date of Patent: Jun. 22, 1999

[54] METHOD OF PROVIDING A SMOOTH SURFACE ON A SUBSTRATE

[75] Inventors: Michael V. Mucci, Hudson, Wis.; Richard M. Olson, Stillwater, Minn.

[73] Assignee: Minnesota Mining and Manufacturing Company, St. Paul, Minn.

[21] Appl. No.: 08/855,659

[22] Filed: May 13, 1997

Related U.S. Application Data

[63] Continuation of application No. 08/348,752, Dec. 2, 1994, which is a continuation of application No. 08/067,708, May 26, 1993.

[51] Int. Cl.[6] ..... B24B 21/00

[52] U.S. Cl. ..... 451/59; 451/62; 451/168

[58] Field of Search ..... 451/59, 166, 168, 451/170, 527, 530, 62

[56] References Cited

U.S. PATENT DOCUMENTS

| | | | |
|---|---|---|---|
| Re. 29,808 | 10/1978 | Wagner | 51/401 |
| 1,941,962 | 1/1934 | Tone | 91/67.9 |

(List continued on next page.)

FOREIGN PATENT DOCUMENTS

| | | |
|---|---|---|
| 2009718 | 8/1990 | Canada . |
| 004454 A3 | 10/1979 | European Pat. Off. . |

(List continued on next page.)

OTHER PUBLICATIONS

Brochure II: What is a Superfinisher? How does it work? Why should someone buy a G.E.M. Superfinisher?, published before Jan. 1, 1990.

Coated Abrasive Superfinishing: Predictable, Repeatable Texturing of Metal Roll Surfaces by K.L. Wilke, S.E. Amundsen, R.C. Lokken (Industrial Abrasives Division/3M: St. Paul, Minnesota, published Jun. 15, 1982.

Superfinishing: The Microfinishing Systems Way, 3M Microfinishing Systems (St. Paul, Minnesota), published Jul. 14, 1988.

"Irgacure® 369" Brochure of Ciba–Geigy Corp., 1993.

*Encyclopedia of Polymer Science and Technology*, vol. 8; John Wiley: New York; pp. 661–665 (1968).

J.V. Crivello, "Photoinitiated Cationic Polymerization", *Ann. Rev. mater. Sci.*, 13, 173–190 (1983).

*Kirk–Othmer Encyclopedia of Chemical Technology, Third Edition*, vol. 1; John Wiley: New York; pp. 35–37 (1978).

V.A. Morozov, "How the Surface Relief of Abrasive Belts Affects Efficiency in Grinding Jobs", *Soviet Engineering Research*, 9, 103–107 (1989).

*Primary Examiner*—Robert A. Rose

*Attorney, Agent, or Firm*—Scott A. Bardell; Paul W. Busse

[57] ABSTRACT

A process for polishing a workpiece. The process comprises the steps of:

(a) placing a structured abrasive article bearing precisely shaped abrasive composites on at least one major surface thereof in contact with a surface of a workpiece having a surface having a scratch pattern having an initial Ra value thereon such that said composite bearing surface is in contact with said workpiece surface;

(b) moving at least one of said workpiece or said structured abrasive article relative to the other in a first abrading direction, while simultaneously moving at least one of said workpiece or said structured abrasive article relative to the other in a second abrading direction not parallel to said first abrading direction such that said second abrading direction crosses said first abrading direction while contact is maintained between said composite bearing surface and said workpiece surface, whereby said initial Ra value is reduced.

Typically, the surface of the workpiece is characterized by a scratch pattern having an initial Ra preferably less than about 120 micrometers, more preferably less than about 90 micrometers, most preferably less than about 20 micrometers.

19 Claims, 5 Drawing Sheets

U.S. PATENT DOCUMENTS

| | | | |
|---|---|---|---|
| 1,988,065 | 1/1935 | Wooddell | 91/68 |
| 2,001,911 | 5/1935 | Wooddell et al. | 51/190 |
| 2,015,658 | 10/1935 | Bezzenberger | 51/278 |
| 2,108,645 | 2/1938 | Bryant | 91/68 |
| 2,115,897 | 5/1938 | Wooddell et al. | 51/188 |
| 2,162,662 | 6/1939 | Indge | 51/64 |
| 2,252,683 | 8/1941 | Albertson | 51/293 |
| 2,755,607 | 7/1956 | Haywood | 51/185 |
| 2,806,772 | 9/1957 | Robie | 51/296 |
| 2,876,086 | 3/1959 | Raymond | 51/298 |
| 2,907,146 | 10/1959 | Dyar | 51/195 |
| 3,048,482 | 8/1962 | Hurst | 51/298 |
| 3,057,256 | 10/1962 | Erban | 88/28.93 |
| 3,211,634 | 10/1965 | Lorenzo | 204/16 |
| 3,517,466 | 6/1970 | Bouvier | 51/358 |
| 3,549,341 | 12/1970 | Kittredge et al. | 51/293 |
| 3,594,865 | 7/1971 | Erb | 18/5 |
| 3,605,349 | 9/1971 | Anthon | 51/402 |
| 3,615,302 | 10/1971 | Rowse et al. | 51/295 |
| 3,631,638 | 1/1972 | Yoshikawa | 51/295 |
| 3,641,719 | 2/1972 | Yang | 51/402 |
| 3,661,544 | 5/1972 | Whitaker | 51/925 |
| 3,689,346 | 9/1972 | Rowland | 186/245 |
| 3,710,514 | 1/1973 | Runge | 51/3 |
| 3,833,703 | 9/1974 | Joos | 264/167 |
| 3,859,407 | 1/1975 | Blanding et al. | 264/62 |
| 3,971,163 | 7/1976 | Trombley | 51/142 |
| 3,991,527 | 11/1976 | Maran | 51/397 |
| 4,011,358 | 3/1977 | Roelofs | 428/287 |
| 4,038,047 | 7/1977 | Haywood | 51/295 |
| 4,055,029 | 10/1977 | Kalbow | 51/395 |
| 4,106,915 | 8/1978 | Kagawa et al. | 51/296 |
| 4,311,489 | 1/1982 | Kressner | 51/298 |
| 4,314,827 | 2/1982 | Leitheiser et al. | 51/298 |
| 4,318,766 | 3/1982 | Smith | 156/330 |
| 4,364,746 | 12/1982 | Bitzer et al. | 51/298 |
| 4,420,527 | 12/1983 | Conley | 428/172 |
| 4,456,500 | 6/1984 | Ibeta | 156/634 |
| 4,539,017 | 9/1985 | Augustin | 51/293 |
| 4,553,982 | 11/1985 | Korbel et al. | 51/298 |
| 4,576,850 | 3/1986 | Martens | 428/156 |
| 4,587,291 | 5/1986 | Gardziella et al. | 524/595 |
| 4,588,258 | 5/1986 | Hoopman | 350/103 |
| 4,588,419 | 5/1986 | Caul et al. | 51/295 |
| 4,623,364 | 11/1986 | Cottringer et al. | 51/309 |
| 4,652,274 | 3/1987 | Boettcher et al. | 51/298 |
| 4,652,275 | 3/1987 | Bloecher et al. | 51/298 |
| 4,735,632 | 4/1988 | Oxman et al. | 51/295 |
| 4,744,802 | 5/1988 | Schwabel | 51/309 |
| 4,751,138 | 6/1988 | Tumey et al. | 428/323 |
| 4,770,671 | 9/1988 | Monroe et al. | 51/293 |
| 4,773,920 | 9/1988 | Chasman et al. | 51/295 |
| 4,799,939 | 1/1989 | Bloecher et al. | 51/293 |
| 4,875,259 | 10/1989 | Appeldorn | 24/576 |
| 4,881,951 | 11/1989 | Wood et al. | 51/309 |
| 4,903,440 | 2/1990 | Larson et al. | 51/298 |
| 4,930,266 | 6/1990 | Calhoun et al. | 51/293 |
| 4,939,870 | 7/1990 | Wang . | |
| 4,950,696 | 8/1990 | Palazotto et al. | 522/25 |
| 4,952,612 | 8/1990 | Brown-Wensley et al. | 522/25 |
| 4,963,164 | 10/1990 | Weber | 51/154 |
| 4,983,458 | 1/1991 | Dejaiffe | 428/402 |
| 4,984,394 | 1/1991 | Suzuki et al. | 51/165.9 |
| 4,985,340 | 1/1991 | Palazzotto et al. | 430/270 |
| 4,997,461 | 3/1991 | Markhoff-Matheny et al. | 51/295 |
| 5,011,508 | 4/1991 | Wald et al. | 51/293 |
| 5,011,513 | 4/1991 | Zador et al. | 51/295 |
| 5,014,468 | 5/1991 | Ravipati et al. | 51/295 |
| 5,015,266 | 5/1991 | Yamamoto | 51/293 |
| 5,022,895 | 6/1991 | Wiand | 51/295 |
| 5,039,311 | 8/1991 | Bloecher | 51/295 |
| 5,040,337 | 8/1991 | Spirito et al. | 51/56 R |
| 5,042,204 | 8/1991 | Johnson | 51/145 R |
| 5,061,294 | 10/1991 | Harmer et al. | 51/295 |
| 5,078,753 | 1/1992 | Broberg et al. | 51/298 |
| 5,086,086 | 2/1992 | Brown-Wensley et al. | 522/25 |
| 5,090,968 | 2/1992 | Pellow | 51/293 |
| 5,093,180 | 3/1992 | Morgan | 428/156 |
| 5,107,626 | 4/1992 | Mucci | 51/281 R |
| 5,131,926 | 7/1992 | Rostoker et al. | 51/309 |
| 5,147,900 | 9/1992 | Palazzotto et al. | 522/25 |
| 5,148,639 | 9/1992 | Sakai et al. | 51/142 |
| 5,152,917 | 10/1992 | Pieper et al. | 51/295 |
| 5,174,795 | 12/1992 | Wiand | 51/295 |
| 5,178,646 | 1/1993 | Barber, Jr. et al. | 51/298 |
| 5,199,227 | 4/1993 | Ohishi | 51/395 |
| 5,201,916 | 4/1993 | Berg et al. | 51/293 |
| 5,203,884 | 4/1993 | Buchanan et al. | 51/295 |
| 5,219,462 | 6/1993 | Bruxvoort et al. | 51/293 |
| 5,224,300 | 7/1993 | Pineau | 51/142 |
| 5,236,472 | 8/1993 | Kirk et al. | 51/298 |
| 5,273,805 | 12/1993 | Calhoun et al. | 428/156 |
| 5,304,223 | 4/1994 | Pieper et al. | 51/293 |
| 5,316,812 | 5/1994 | Stout et al. | 428/64 |
| 5,318,604 | 6/1994 | Gorsuch et al. | 51/293 |
| 5,368,619 | 11/1994 | Culler | 51/308 |
| 5,378,251 | 1/1995 | Culler et al. | 51/295 |
| 5,435,816 | 7/1995 | Spurgeon et al. | 51/295 |
| 5,437,754 | 8/1995 | Calhoun | 156/231 |
| 5,453,312 | 9/1995 | Haas et al. | 428/143 |
| 5,454,844 | 10/1995 | Hibbard et al. | 51/295 |
| 5,489,235 | 2/1996 | Gagliardi et al. | 451/527 |
| 5,527,368 | 6/1996 | Supkis et al. | 51/298 |

FOREIGN PATENT DOCUMENTS

| | | | |
|---|---|---|---|
| 109851 A2 | 5/1984 | European Pat. Off. . | |
| 168065 A1 | 1/1986 | European Pat. Off. . | |
| 225296 | 6/1987 | European Pat. Off. . | |
| 345239 A1 | 12/1989 | European Pat. Off. . | |
| 554668 A1 | 8/1993 | European Pat. Off. . | |
| 650803 A1 | 5/1995 | European Pat. Off. . | |
| 650807 A1 | 5/1995 | European Pat. Off. . | |
| 881239 | 4/1943 | France . | |
| 1361585 | 4/1964 | France . | |
| 2354373 | 1/1978 | France . | |
| 57-121458 | 7/1982 | Japan . | |
| 58-196974 | 11/1983 | Japan . | |
| 60-9663 | 1/1985 | Japan . | |
| 61-244468 | 10/1986 | Japan . | |
| 62-255069 | 11/1987 | Japan . | |
| H2-83172 | 3/1990 | Japan . | |
| 4-159084 | 6/1992 | Japan . | |
| 6-190737 | 7/1994 | Japan . | |
| 749650 | 7/1980 | U.S.S.R. . | |
| 975375 | 11/1982 | U.S.S.R. . | |
| 996178 | 2/1983 | U.S.S.R. . | |
| 1316805 | 6/1987 | U.S.S.R. . | |
| 1712130 | 2/1992 | U.S.S.R. . | |
| 1731597 A1 | 5/1992 | U.S.S.R. . | |
| 578408 | 6/1946 | United Kingdom | 51/395 |
| 1005448 | 9/1965 | United Kingdom . | |
| 2043501 | 10/1980 | United Kingdom . | |
| 2094824 | 9/1982 | United Kingdom . | |
| WO 92/15626 | 9/1972 | WIPO . | |
| WO 93/12911 | 7/1993 | WIPO . | |
| WO 93/13912 | 7/1993 | WIPO . | |
| WO 94/20264 | 9/1994 | WIPO . | |
| WO 94/27780 | 12/1994 | WIPO . | |

FIG.1
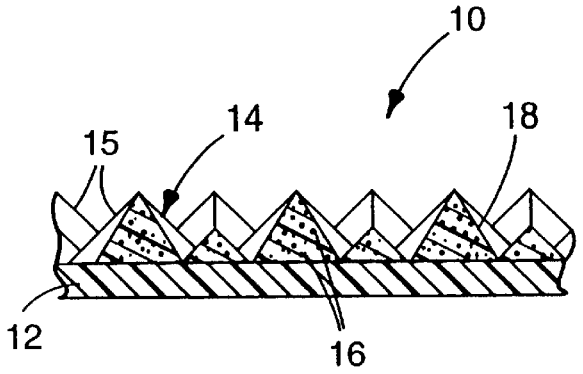
FIG.2
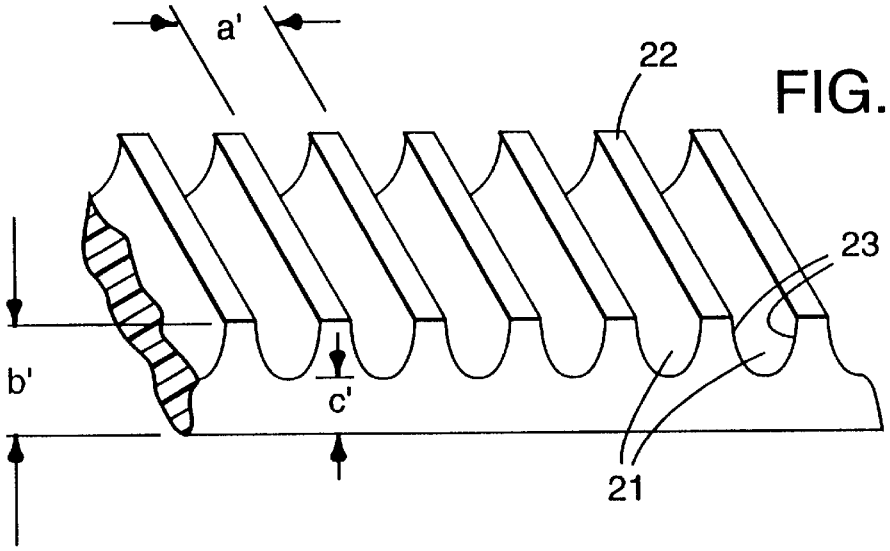
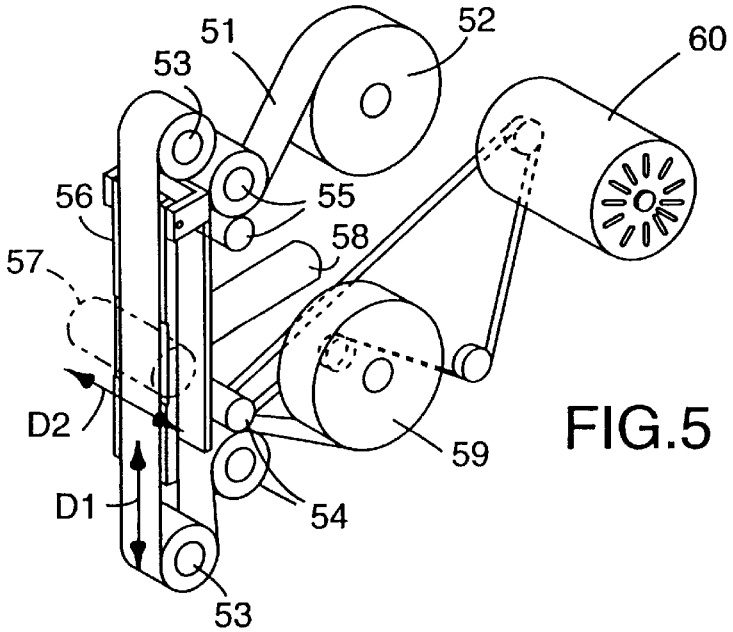
FIG.5

METHOD OF PROVIDING A SMOOTH SURFACE ON A SUBSTRATE

This application is a continuation of U.S. application Ser. No. 08/348,752, filed Dec. 2, 1994, which is a continuation of U.S. application Ser. No. 08/067,708, filed May 26, 1993.

BACKGROUND OF THE INVENTION

1. Field of the Invention

The invention relates to a method for providing a polished finish to the surface of a substrate by means of an abrasive article. Such polished finishes are important for surfaces in a variety of industrial applications, such as printing, manufacturing of engine components, machine tools, coating tools, cutting tools, etc.

2. Discussion of the Art

A number of technologies require the provision of a polished surface on a workpiece for the proper operation of equipment utilizing the workpiece. A polished surface is required in engine components such as journals, crank pins, crank shafts, cam shafts, etc., as well as in knife cutters, printing rolls, etc. A polished surface permits accurate cutting, vibration-free operation, low surface-to-surface friction, and long component life. Such surfaces can be flat or substantially planar, can be of simple curvature, i.e., having a circular, parabolic, hyperbolic, oval, or elliptical cross section, can be of complex curvatures such as in the surface of a propeller, or such surfaces can have angular edges, e.g., the workpieces can have such shapes as cubes, pyramids, knife edges, etc. Various machines capable of directing an abrasive material in a conformed path against a surface to render the surface smooth have been developed. Conventional abrasive apparatus and abrasive compositions are disclosed in Runge, U.S. Pat. No. 3,710,514, Weber, U.S. Pat. No. 4,963,164, Suzuki et al., U.S. Pat. No. 4,984,394, Spirito et al., U.S. Pat. No. 5,040,337, Morgan, U.S. Pat. No. 5,093,180, and Rostoker et al., U.S. Pat. No. 5,131,926. Johnson, U.S. Pat. No. 5,042,204, discloses a finishing machine having an advanced oscillating head that uses an abrasive film material that produces a consistently precise finish without abrasive tool wear and realignment of the abrasive tools. These patents generally relate to devices and abrasives for use in superfinishing rotary crank pins, crank shafts, cam shafts, or for use in finishing cutting tools, aircraft engine blades, printing rolls, etc., to provide a fine surface thereon.

Two common types of abrasive articles that have been utilized in polishing operations include bonded abrasives and coated abrasives. Bonded abrasives are formed by bonding abrasive particles together, typically by a molding process, to form a rigid abrasive article. Coated abrasives have a plurality of abrasive particles bonded to a backing by means of one or more binders. Coated abrasives utilized in polishing processes are typically in the form of endless belts, tapes, or rolls which are provided in the form of a cassette. Examples of commercially available polishing products include "IMPERIAL" Microfinishing Film (hereinafter IMFF) and "IMPERIAL" Diamond Lapping Film (hereinafter IDLF), both of which are commercially available from Minnesota Mining and Manufacturing Company, St. Paul, Minn.

Structured abrasive articles have been developed for common abrasive applications. Pieper et al., U.S. Pat. No. 5,152,917, discloses a structured abrasive article containing precisely shaped abrasive composites. These abrasive composites comprise a plurality of abrasive grains and a binder.

Mucci, U.S. Pat. No. 5,107,626, discloses a method of introducing a pattern into a surface of a workpiece using a structured abrasive article.

Conventional polishing methods involve abrading a surface with a series of abrasive products. Initially, the abrasive products contain abrasive particles of larger sizes followed by abrasive products containing abrasive particles of smaller sizes. Such a reduction in size of the abrasive particles in the series of products is usually required to gradually reduce the scratch size of the surface finish to the desired level. Depending on the initial scratch dimension, as many as seven different abrasive products having abrasive particles of decreasing size may be required to produce a polished surface from an initial scratch dimension of about 20 micrometers. It would be desirable to develop a method of polishing that is simpler than using a series of abrasive products to provide a smooth finish.

SUMMARY OF THE INVENTION

This invention provides a process for refining or polishing a workpiece.

The process of this invention comprises the steps of:

(a) placing a structured abrasive article bearing precisely shaped abrasive composites on at least one major surface thereof in contact with a surface of a workpiece having a surface having a scratch pattern having an initial Ra value thereon such that said composite bearing surface is in contact with said workpiece surface;

(b) moving at least one of said workpiece or said structured abrasive article relative to the other in a first abrading direction, while simultaneously moving at least one of said workpiece or said structured abrasive article relative to the other in a second abrading direction not parallel to said first abrading direction such that said second abrading direction crosses said first abrading direction while contact is maintained between said composite bearing surface and said workpiece surface, whereby said initial Ra value is reduced.

Workpieces are typically in the shape of cylinders, but they can also be in other shapes, such as, for example, prisms, lobes, plates, spheres, paraboloids, cones, frustocones, etc. Typically, the surface of the workpiece is characterized by a scratch pattern having an initial Ra preferably less than about 20 micrometers, more preferably less than about 10 micrometers, most preferably less than about 5 micrometers.

The structured abrasive article comprises a backing having at least one abrasive composite, preferably an array of abrasive composites, bonded thereto. Each abrasive composite comprises a plurality of abrasive particles formed into a precisely defined shape.

BRIEF DESCRIPTION OF THE DRAWINGS

FIGS. 1 and 2 illustrate cross sections of structured abrasive articles useful in the process of this invention.

FIG. 3 shows a 20× photograph. FIG. 4 shows a 100× photograph.

FIG. 5 is a schematic view that illustrates one type of device that can be used to obtain a polished finish on a surface of a workpiece by using the structured abrasive article.

Figure 3:
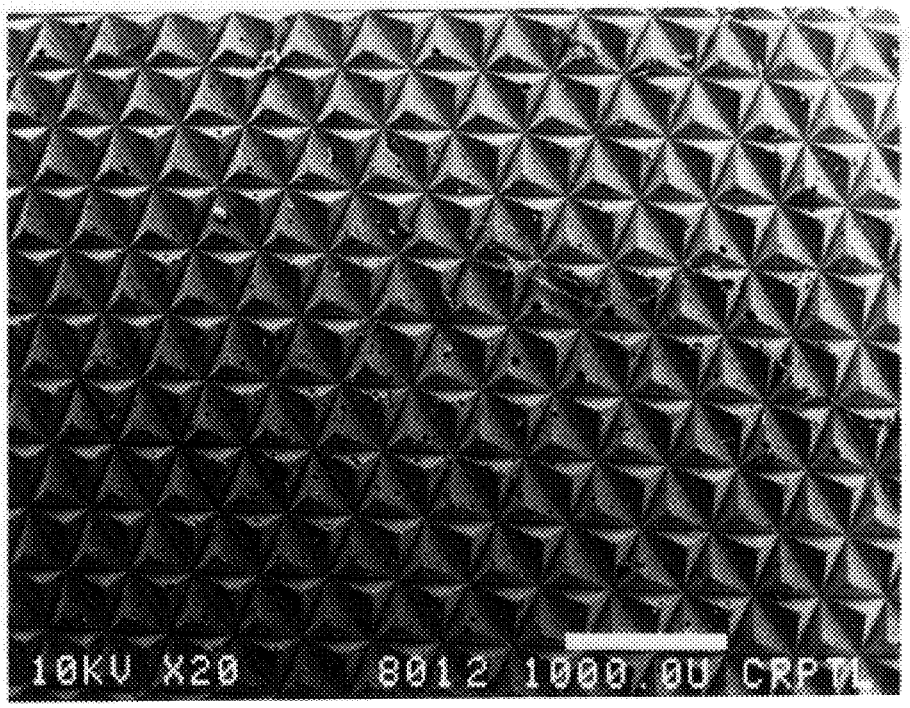
FIGS. 3 and 4 are scanning electron microscope photographs of structured abrasive articles useful in the process of this invention.

For the purposes of this invention, the term Ra is the international parameter of surface roughness or surface polish. Ra is the arithmetic mean of the departure of the roughness profile from the mean line. The greater the value of Ra, the rougher is the surface finish.

DETAILED DESCRIPTION OF THE INVENTION

This invention provides a process for obtaining a polished finish on the surface of a workpiece. The process involves the use of a structured abrasive article.

As used herein, the expression "structured abrasive article" means an abrasive article wherein a plurality of precisely shaped abrasive composites, each comprising abrasive grits distributed in a binder, are disposed on a backing in a non-random array.

As used herein, the expression "precisely shaped abrasive composite" means an abrasive composite having a shape that has been formed by curing a mixture of abrasive grits and a curable binder precursor while the mixture fills a cavity in a production tool. A precisely shaped abrasive composite would thus have precisely the same shape as the cavity in the production tool in which the composite was formed. A plurality of such precisely shaped abrasive composites disposed on a backing forms a pattern. This pattern is typically the inverse of the pattern formed by the cavities in the production tool. Each precisely shaped abrasive composite is defined by a boundary, the base portion of the boundary corresponding to the interface with the backing to which the precisely shaped abrasive composite is adhered, the remaining portions of the boundary being defined by the walls of the cavity in the production tool in which the composite was cured.

As used herein, the expression "first abrading direction" means the direction traversed by a precisely shaped abrasive composite during the operation of imparting a groove to the surface of a workpiece, as described in Mucci, U.S. Pat. No. 5,107,626, incorporated herein by reference. In the case of a workpiece that typically rotates about an axis, e.g., a cylinder or lobe, the major abrading direction is typically either the path that a given point on the curved surface of the workpiece traverses as the workpiece rotates about the axis or, if the workpiece is held stationary, the path that a given point on the curved surface of the workpiece would have traversed if the workpiece had been rotated about the axis. In the case of a workpiece that moves up and down, the major abrading direction is either the path that a given point on the surface of the workpiece traverses as the workpiece moves up and down or the path that a given point on the surface of the workpiece would have traversed if the workpiece had been moved up and down. Cases other than those described, i.e., different workpiece configurations, different structured abrasive article configurations, are also within the scope of this invention.

As used herein, the expression "second abrading direction" means the direction traversed by a precisely shaped abrasive composite when the composite crosses a groove that had been imparted to the surface of a workpiece.

The workpiece can be any solid material. Materials of workpieces include, but are not limited to, metal and metal alloys, such as carbon steel, tool steel, chrome, stainless steel, brass, aluminum, high nickel alloys, and titanium, glass, organic thermosetting polymers, organic thermoplastic polymers, rubber, painted surfaces, ceramics, wood, and inorganic materials, such as marble, stone, granite, and the like. Workpieces may be provided in the form of a roll, slab, or the like. The surface that is to be finished can be relatively flat or contoured. Examples of such workpieces include lenses, journals, crankshafts, camshafts, crankpins, coating rolls, printing rolls, and the like. The dimensions of cylindrical workpieces can generally range from as little as 1 centimeter to 5 meters and more in diameter, and up to and more than 10 meters in length. Rolls or slabs can be either solid or hollow, depending on the application. Hollow rolls or slabs are useful when the weight of the roll or slab is of concern, or when it is desirable to heat or chill the roll or slab by passing liquid through a cavity therein.

Referring to FIG. 1, coated abrasive article 10 comprises a backing 12 bearing on one major surface thereof a plurality of precisely shaped abrasive composites 14. The abrasive composites comprise a plurality of abrasive grits 16 dispersed in a binder 18. In this particular embodiment, the binder 18 also bonds precisely shaped abrasive composites 14 to backing 12. The precisely shaped abrasive composites 14 have a discernible precise shape. The abrasive grits 16 preferably do not protrude beyond the planes 15 of the precise shape before the coated abrasive article 10 is used. As the coated abrasive article 10 is used to polish or superfinish a surface, the precisely shaped abrasive composite can wear, particularly at the leading edges of the composite, to expose unworn abrasive grits for contact with a workpiece.

FIG. 2 is an illustration of a pattern of precisely shaped abrasive composites arranged in what is commonly referred to as an ordered profile. The periodicity of this pattern is designated by the distance marked "a'". The high peak value of the pattern is designated by the distance marked "b'" and the low peak value of the pattern is designated by the distance marked "c'". In FIG. 2, the planar boundary of the precisely shaped abrasive composite is designated by reference numbered 23. FIG. 2 shows a series of depressions 21 and land areas 22.

FIG. 3 is a scanning electron microscope photograph taken at 20× magnification of a top view of an abrasive article having an array of pyramidal shapes.

Figure 4:
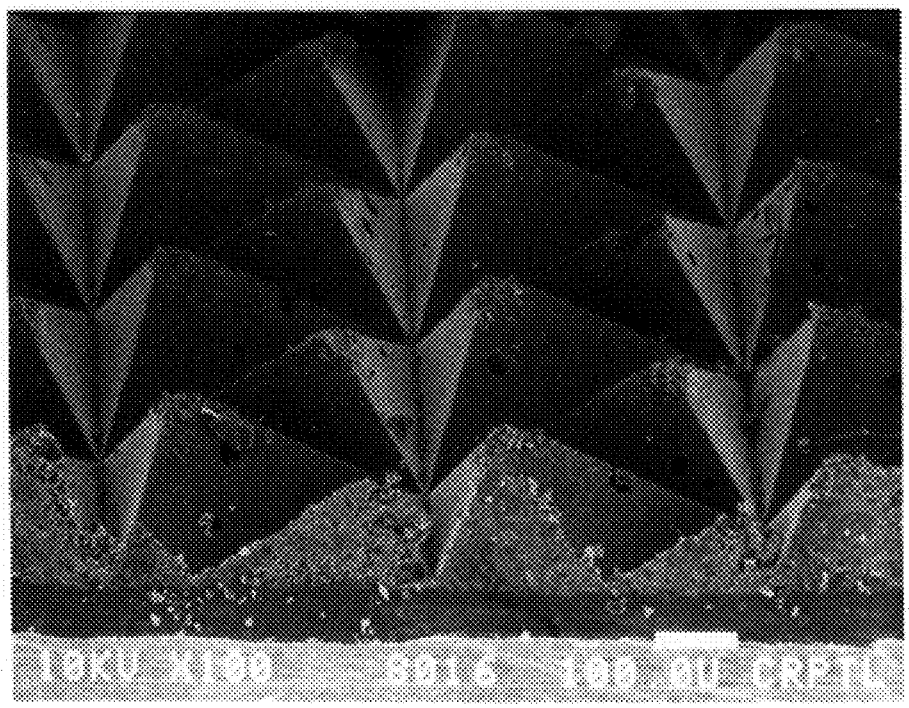

FIG. 4 is a scanning electron microscope photograph taken at 100× magnification of the side view of an abrasive article having an array of pyramidal shapes. These abrasive articles are disclosed in Mucci, U.S. Pat. No. 5,107,626 and Pieper et al., U.S. Pat. No. 5,152,917; and Spurgeon, U.S. Ser. No. 08/175,694, filed Dec. 30, 1993, now allowed, all of which are incorporated herein by reference.

Materials suitable for the backing of the coated abrasive article useful in the method of the present invention include any flexible web, including polymeric film, paper, cloth, metallic film, vulcanized fiber, non-woven substrates, and any combinations of the foregoing, and treated versions of the foregoing materials. The backing preferably comprises a polymeric film, such as a film of polyester, polypropylene, polyethylene, polyvinylchloride, etc. The film preferably can be primed with materials, such as a polyethylene-acrylic acid copolymers, aziridine materials, to promote adhesion of the abrasive composites to the backing. The backing can be transparent to ultraviolet radiation or other radiation sources. The backing can be opaque to ultraviolet radiation. If the backing is opaque to ultraviolet radiation, the binder of the abrasive composite can be cured by ultraviolet radiation in the manner as disclosed in Spurgeon, U.S. Ser. No. 08/175, 694, filed Dec. 30, 1993 now allowed. The backing can be laminated to another substrate for strength, support, or dimensional stability. Lamination can be accomplished before or after the structured abrasive article is formed.

The precisely shaped abrasive composites can be formed from a slurry comprising a plurality of abrasive grits dispersed in an uncured or ungelled binder. Upon curing or gelling, the precisely shaped abrasive composites are set, i.e., fixed, in shapes and in an array determined by the shapes and positions of the cavities in the production tool.

The size of the abrasive grits used in preparing the mixture that is then cured to form the structured abrasive article typically ranges from about 0.1 to 500 micrometers, preferably from about 0.5 to 50 micrometers. Examples of abrasive grits suitable for the precisely shaped abrasive composites include commonly available hard abrasive granular materials. Examples of such materials include fused aluminum oxide, heat treated aluminum oxide, ceramic aluminum oxide, silicon carbide, green silicon carbide, alumina-zirconia, ceria, iron oxide, garnet, diamond, cubic boron nitride, and mixtures thereof.

The binder is capable of providing a medium in which the abrasive grits can be distributed. Examples of binders suitable for precisely shaped abrasive composites useful in this invention include phenolic binders, aminoplast binders having pendent α,β-unsaturated carbonyl groups, urethane binders, epoxy binders, acrylated binders, acrylate-isocyanurate binders, urea formaldehyde binders, isocyanurate binders, acrylated urethane binders, acrylated epoxy binders, glue, and mixtures thereof. The binder can also comprise a thermoplastic binder or mixtures of one or more thermoplastic binders with the binders recited previously.

Depending on the binder employed, the curing or gelling is typically promoted by using an energy source such as heat, infrared radiation, electron beam radiation, ultraviolet radiation, gamma radiation, X-rays, or visible radiation.

The binder is preferably radiation curable. A radiation curable binder is a binder that, under the influence of radiant energy, undergoes a chemical reaction that results in at least a partial cure throughout the binder material. Such binders often polymerize by means of a free radical mechanism. Binders that cure via a free radical polymerization mechanism and are useful in the process of preparing abrasive articles useful in the method of this invention include acrylated urethanes, acrylated epoxies, aminoplast derivatives having pendent α,β-unsaturated carbonyl groups, ethylenically unsaturated compounds, isocyanate derivatives having pendent acrylate groups, and other resins having pendent α,β-unsaturated groups.

If the binder is cured by ultraviolet radiation or visible light, a photoinitiator is normally used to initiate free radical polymerization. Examples of photoinitiators suitable for this purpose include organic peroxides, azo compounds, quinones, benzophenones, nitroso compounds, acryl halides, hydrazones, mercapto compounds, pyrylium compounds, triacrylimide azoles, bisimidazoles, chloralkyltriazines, benzoin ethers, benzil ketals, thioxanthones, and acetophenone derivatives. If the binder is cured by visible radiation, the preferred photoinitiator is 2-benzyl-2-N,N-dimethylamino-1-(4-morpholinophenyl)-1-butanone. Examples of such photoinitiators suitable for initiation of polymerization by visible radiation are described in Oxman et al., U.S. Pat. No. 4,735,632, incorporated herein by reference.

The weight ratio of abrasive particles to binder generally ranges from about 1:6 to about 6:1. Preferably, from about 2 to 3 parts by weight of abrasive particle is used for each part by weight of binder. This ratio varies depending on the size of abrasive particles and binder capacity.

The precisely shaped abrasive composite can also contain other optional materials in addition to the abrasive particles and the binder. Such additional materials include coupling agents, wetting agents, antistatic agents, dyes, pigments, plasticizers, fillers, release agents, grinding aids, and mixtures thereof.

Precisely shaped abrasive composites typically are formed in a regular geometric shape and the composites are arranged in a regular distribution or array on the backing. In general, the shape utilized will repeat with a certain periodicity. The precisely shaped abrasive composites can be arranged in a single rank or file of the array on the backing or, preferably, the precisely shaped abrasive composites can be arranged in two or more ranks or files on the backing. A preferred shape for the abrasive composite is a pyramid having a rectangular or triangular base, cone, or the like. The shape can be formed through the use of an appropriately shaped tool or can be formed after the structured abrasive article is worn during use. The preferred height for such pyramids or cones ranges from about 50 to about 350 micrometers (from about 2 to about 14 mils).

The structured abrasive article can be in the form of an endless belt, a disk, a sheet, or a flexible tape that is sized so as to be capable of being brought into contact with a workpiece. The precisely shaped abrasive composites can be disposed on one or both major surfaces of the backing. For a structured abrasive article in the form of an endless belt, the belt is typically mounted over a contact wheel and idler wheel. The contact wheel provides a means of a support for the structured abrasive article during the polishing process. For a disc, the disc is secured to a support pad by a mechanical fastener or an adhesive. For a structured abrasive article in the form of a tape (i.e., a two-ended ribbon of the structured abrasive article), the fresh or unused portion of structured abrasive article is generally unwound from a supply roll and the used or worn portion of structured abrasive article is generally wound onto a take-up roll. The tape, the supply roll, and the take-up roll can be housed in a cartridge or cassette. The supply roll is typically frictionally retained in the cartridge or cassette so as to not rotate freely so that tension can be maintained to provide consistent feeding and tracking. The rate the tape is fed can be precisely controlled by known techniques to optimize the surface finish. For example, the take-up roll can be driven by a variable speed D.C. take-up motor. With such drive means, the structured abrasive article can be continuously fed through an interface formed by the merger of the abrasive article and the workpiece surface at a rate of from about 0.1 to about 60 cm/minute, preferably from about 5 to about 30 cm/minute. The structured abrasive article can also be held stationary and then can be periodically indexed as desired. As used herein, the term "index" means to move a machine or a piece of work held in a machine tool so that a specific operation will be repeated at definite intervals of space. The structured abrasive article is pressed against the workpiece by means of a support roll or support shoe. The support shoe can be a platen, roller, deadhead, or any other device that provides the desired pressure between the structured abrasive article and workpiece at their interface. Pressure can be maintained through the use of hydraulic fluids, air pressure, springs, electrically driven components, etc. The contact force of the structured abrasive article on the surface of the workpiece generated by the support shoe can be precisely controlled, if desired, by known techniques.

The workpiece can be moved relative to the structured abrasive article in a direction referred to herein as the first abrading direction. Alternatively, the structured abrasive article can be moved relative to the workpiece in the first abrading direction. It is possible to move both the workpiece and structured abrasive article simultaneously so long as there is relative movement between the two in the first abrading direction. In order to clarify what is meant by the phrase "the first abrading direction", the following cases of movement in the first abrading direction are provided:

| Workpiece | Direction of Movement | Structured Abrasive Article | Direction of Movement |
|---|---|---|---|
| Cylinder[1] | Cylinder rotates about axis | Belt or tape[3] | Belt or tape is stationary |
| Cylinder[1] | Cylinder is stationary | Belt or tape[3] | Belt or tape is driven over a support[4] |
| Lobe[1] | Lobe rotates about axis | Belt or tape[3] | Belt or tape is stationary |
| Lobe[1] | Lobe is stationary | Belt or tape[3] | Belt or tape is driven over a support[4] |
| Prism[2] | Prism moves up and down | Belt or tape[2] | Belt or tape is stationary |
| Prism[2] | Prism is stationary | Belt or tape[3] | Belt or tape is driven over a support[4] |
| Rectangular barstock[2] | Barstock moves up and down | Belt or tape[3] | Belt or tape is stationary |
| Rectangular barstock[2] | Barstock is stationary | Belt or tape[3] | Belt or tape is driven over a support[4] |

[1]The axis of a workpiece runs from a first base to a second base and is perpendicular to both bases. The precisely shaped abrasive composites of the structured abrasive article are placed in contact with the curved surface of the cylinder and lobe, not with the bases thereof, which bases are in parallel planes and are perpendicular to the axis.
[2]The precisely shaped abrasive composites are placed in contact with a face of the prism that is a parallelogram. The precisely shaped abrasive composites are placed in contact with the rectangular face of the rectangular barstock.
[3]Belt or tape is mounted on contact wheel and idler wheel.
[4]A typical support can be a wheel, shoe, or platen.

The structured abrasive article or the workpiece also moves in a direction not parallel to the first abrading direction such that any scratch formed in the first abrading direction is crossed. The direction of crossing is called the second abrading direction. The second abrading direction can be, but does not have to be, perpendicular to the scratch formed in the first abrading direction so long as the second abrading direction provides some measurable perpendicular component of movement at the interface of the structured abrasive article and the workpiece. In the case in which movement in the second abrading direction is not exactly perpendicular to the scratch formed in the first abrading direction, the expression "measurable perpendicular component" indicates that significant movement in the perpendicular direction is typically present. By moving the workpiece or structured abrasive article in the second abrading direction, the precisely shaped abrasive composites of the structured abrasive article are forced to cross the existing scratch pattern in the workpiece, with the result that the Ra of the existing scratch pattern is quickly reduced. The movement in the second abrading direction may have only a perpendicular component or it may have one component perpendicular to the first abrading direction and one component parallel to the first abrading direction. The movement in the second abrading direction is typically a pattern of oscillations at a fixed amplitude such that the abrasive article produces a cross hatched pattern of scratches. This cross hatched pattern usually has an Ra less than the Ra of patterns produced with no oscillation. The lower Ra corresponds to a more polished surface on the workpiece.

In characterizing the surface of workpieces finished in accordance with the method of this invention, the most useful criteria is the Ra (roughness average). Ra is a common measure of roughness used in the abrasives industry. Ra is defined as the arithmetic mean of the departures of the roughness profile from the mean line. Ra is measured with a profilometer probe, which is a diamond tipped stylus. It is usually recorded in microinches or micrometers. In general, the lower the Ra, the smoother the finish. Common profilometers include those sold under the tradenames "Surtronic", "Surfcom", and "Perthometer".

A liquid coolant or lubricant is generally used in abrading applications. The coolant is typically instrumental in removing heat generated at the abrading interface and removing workpiece swarf or debris. Examples of coolants typically used in abrading operations include water, water with a rust inhibitor, water with a soluble oil, synthetic water-soluble lubricants, and organic oils, such as mineral oil, seal oil, and linseed oil. Selection of the appropriate coolant is well-known to one of ordinary skill in the art and is usually dependent upon the abrasive article, the workpiece material, desired finishing results, and process limitations.

Figure 8:
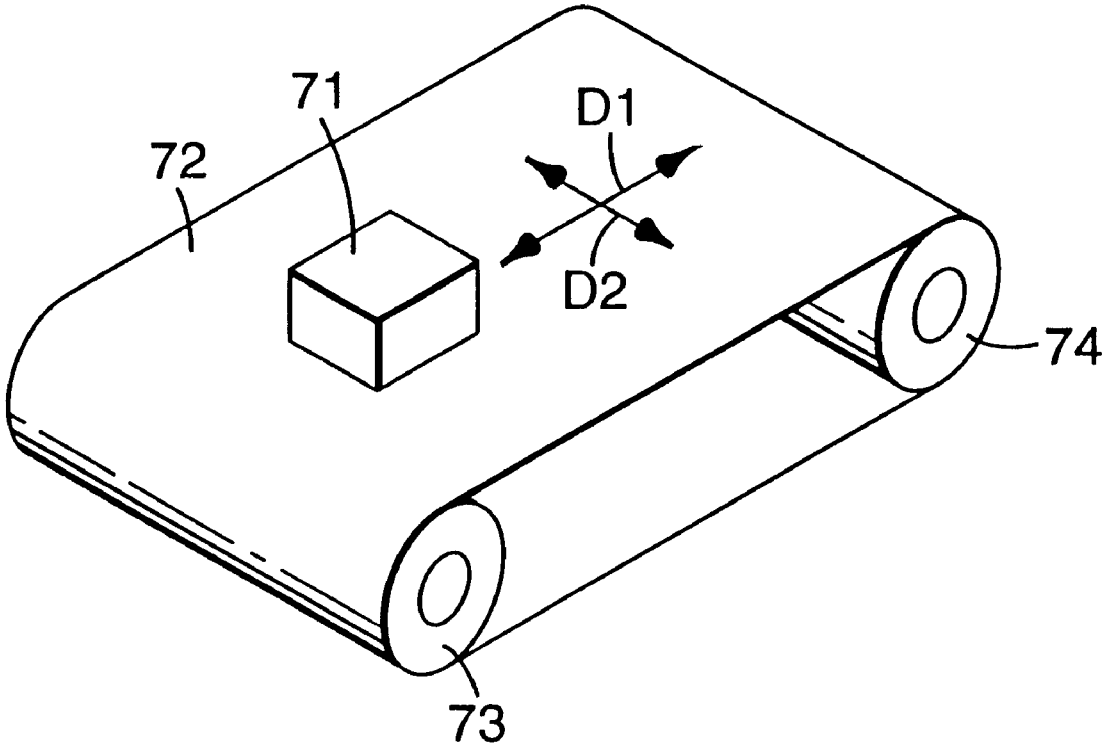
FIG. 8 is a schematic view that illustrates one type of device that can be used to obtain a polished finish on a surface of a workpiece by using the structured abrasive article.

Actual operation of the process of this invention will now be described. FIG. 5 is a schematic perspective depiction of one class of machine that can be used to obtain smooth surface finishes by means of the process of this invention. In FIG. 5, the structured abrasive article is in the form of a tape 51 which is supplied from a tape supply spool 52. The tension of the tape 51 is adjusted by means of idler rolls 53. The path of the tape is directed by means of drive rolls 54 and pinch rolls 55. The first abrading direction is represented by directional arrow D1. Pressure of the tape 51 against the workpiece 57 is provided by urging a support shoe or platen 56 against the back side of the tape 51 toward the surface of the workpiece 57 until the desired interface pressure is achieved. The shape of the interface between the tape 51 and the workpiece 57 is dictated by the shape of the contacting surface of the support shoe 56. Support shoe 56 directs the precisely shaped abrasive composites of the tape 51 against the workpiece 57. At the interface between the tape 51 and the workpiece 57, load is applied to the tape 51 by means of an air driven cylinder 58 in contact with the back of the support shoe 56. The tape 51 can be oscillated at the interface between the tape 51 and the workpiece 57 vertically, horizontally, or at any fixed angle in the plane of the interface between the tape 51 and the workpiece 57. The second abrading direction is represented by directional arrow D2. Used tape is recovered on a takeup spool 59. The drive rolls 54 are driven by a D.C. motor 60. In another embodiment, an abrasive tape can be converted into an endless belt and used in that manner. In FIG. 8, workpiece 71 is supported on coated abrasive article 72, which is in the form of an endless belt. Endless belt 71 is mounted over a contact wheel 73 and an idler wheel 74. The contact wheel 73 provides a means of support for the structured abrasive article 71 during the polishing process. Directional arrows D1 and D2 show the first and second abrading directions, respectively, of the coated abrasive article.

A structured abrasive article in the form of a tape can be fed, or indexed, at rates ranging anywhere from about 0.01 cm/second to about 1 cm/second, preferably from about 0.05 cm/second to about 0.5 cm/second, and faster. Usually, the faster the indexing of the structured abrasive article, the rougher will be the surface finish, on account of the introduction of fresh, sharp, precisely shaped abrasive composites.

In still another embodiment, the structured abrasive article can be in the form of disc or daisy. The disc or daisy can be secured to a support pad or back-up pad by a mechanical fastener or chemical bonding. In the case of polishing a lens, the disc or daisy is secured to a support shoe. The lens rotates about an axis. The disc or daisy can revolve in such a manner that the first abrading direction is in the form of a circle or an ellipse. Additionally, the disc or daisy will be moved in a second direction that crosses the grooves formed in the first abrading direction. An example of such a polishing machine is Rocket Model PP-1 from Coburn, (Muskogee, Okla.).

Sufficient pressure is applied so that the structured abrasive article abrades or removes a controlled amount of material from the surface of the workpiece to provide a finished surface. The amount of pressure at the abrading interface is carefully controlled. If a great amount of pressure is applied, e.g., up to about 700 kilopascals (about 100 pounds per square inch), the rate of abrasion will be greater, the surface finish on the workpiece will be rougher, and the structured abrasive article will tend to wear faster. Likewise, if a smaller amount of pressure is applied, e.g., less than 50 kilopascals (less than 5 pounds per square inch), the rate of abrasion will be lower, the surface finish on the workpiece will be smoother, and the structured abrasive article will tend to wear more slowly. The specific amount of pressure employed will depend on the particular abrading application, the nature of the workpiece, and the result desired. A pressure of about 3 to 300 kilopascals is typical.

In one embodiment of the method of this invention, the structured abrasive article is brought into contact with the surface of the workpiece, e.g., the curved surface of a cylinder. The structured abrasive article is moved along the surface of the workpiece in the first abrading direction, while the platen, or shoe, over which the backside of the abrasive article passes is moved from side-to-side. Alternatively, it is possible to move the workpiece from side-to-side rather than the platen or shoe.

Prior to being abraded according to the process of this invention, the surface of the workpiece may have a relatively rough, flat, contoured, or random profile. At the completion of the process of this invention, the surface of the workpiece will have a significantly smoother surface finish than was present before abrading. This very smooth finish is characterized by a numerical value, the Ra, that is measured by obtaining a trace profile with a profilometer.

The method of this invention provides the surface of the workpiece with a smoother or finer finish than can be obtained with a single conventional coated abrasive article utilizing conventional coated abrasive polishing techniques. Additionally, the finer finish can be achieved with far fewer finishing steps than are conventionally required. The method of this invention generally provides a predictable, consistent finish over the entire surface of a workpiece. This is preferably accomplished by means of a tape that moves continuously through the interface between the abrasive article and the workpiece.

Variable parameters involved in providing an optimum finish on the surface of a workpiece include tape or belt speeds that can range from 0 to 60 centimeters per minute, interface contact forces that can range from 0 to 400 Newtons, an oscillation of either the abrasive article or the workpiece at a frequency of from 0 to 1650 cycles per minute, an amplitude of oscillation of from about 0.01 cm to about 15 cm, and the optional use of a coolant and/or lubricant at the interface between the structured abrasive article and workpiece. These parameters are selected on the basis of the type of abrasive article, the type and shape of workpiece, and the finish desired. Typical parameters are set forth in "Coated Abrasive Superfinishing: Predictable, Repeatable Texturing of Metal Roll Surfaces" by K. L. Wilke, S. E. Amundson, and R. C. Lokken, Industrial Abrasives Division/3M, St. Paul, Minn., incorporated herein by reference.

EXAMPLES

The following non-limiting examples will further illustrate the invention. All parts, percentages, ratios, etc. in the examples are by weight unless otherwise indicated. The following abbreviations and trade names are used throughout.

| | |
|---|---|
| TATHEIC | triacrylate of tri-(hydroxy ethyl) isocyanurate |
| TMPTA | trimethylol propane triacrylate |
| PH1 | 2,2-dimethoxy-2-phenylacetophenone, commercially available from Ciba Geigy under the trade designation "Irgacure 651" |
| PH2 | 2-benzyl-2-N,N-dimethylamino-1-(4-morpholinophenyl)-1-butanone, commercially available from Ciba Geigy under the trade designation "Irgacure 369" |
| ASF | amorphous silica filler, density of 2.6–2.8 g/cc, surface area of 36–38 $m^2/g$, commercially available from Degussa under the trade designation "OX-50" |
| CA | silane coupling agent, 3-methacryloxypropyl-trimethoxysilane, commercially available from Union Carbide under the trade designation "A-174" |
| WAO | white aluminum oxide |

Example 1

An abrasive article was made according to the teaching in Pieper et al., U.S. Pat. No. 5,152,917. The binder precursor consisted of 50 parts TATHEIC, 50 parts TMPTA, and two (2) parts PH1. The abrasive slurry consisted of 29 parts of the afore-mentioned binder precursor, one (1) part ASF, one (1) part CA, and 69 parts WAO having an average particle size of 40 micrometers. The abrasive slurry was coated onto a production tool having a plurality of a pyramidal-shaped cavities in one major surface thereof. The abrasive slurry filled the cavities in the tool. The bases of the pyramids butted up against one another. The bases of the pyramids were triangular with two sides having lengths of about 430 micrometers, while the other side had a length of about 500 micrometers. The angle between the two shorter sides of two adjacent precisely shaped abrasive composites was about 55°. The height of the pyramid was about 180 micrometers. Next a 130 micrometer thick substrate made of polyester film was pressed against the production tool by means of a roller and the abrasive slurry wetted the front surface of the polyester film. The front surface of the polyester film contained an ethylene acrylic acid primer. Then ultraviolet light was transmitted through the polyester film into the uncured binder precursor. The ultraviolet light dosage was 120 watts/centimeter. The source of ultraviolet light was a H-bulb (Aetek system). There were two consecutive exposure times at 4.87 meters/minute. This ultraviolet light transformed the abrasive slurry into an abrasive composite. Next, the polyester film/abrasive composite construction was separated from the production tool to form an abrasive article.

Example 2

The abrasive article of this example was made in the same manner as was used in Example 1, except for the following changes. The slurry was coated onto a production tool having a triangular grooved pattern such that the cross section of the article demonstrated isosceles triangles which ran continuously the length of the abrasive tape. The photoinitiator was one (1) part PH2. The abrasive article was made on a polypropylene tool in a single pass over a V-bulb fusion system at dosage of 240 watts/cm at a rate of 15.2 meters/minute. The abrasive slurry filled the grooved recesses in the tool. The base width of the grooves in the tool was about 360 micrometers and the height of the grooves in the tool was about 180 micrometers.

Comparative Example A

The abrasive article for Comparative Example A was a 40 micrometer aluminum oxide microfinishing film abrasive article, commercially available from Minnesota Mining and Manufacturing Company, St. Paul, Minn. under the trade designation "IMPERIAL" (hereinafter "IMFF").

Comparative Example B

The abrasive article for Comparative Example B was a 30 micrometer aluminum oxide beaded film abrasive article, commercially available from Minnesota Mining and Manufacturing Company, St. Paul, Minn. under the trade designation "IMPERIAL".

Test Procedure 1

The coated abrasive article was converted into 10 centimeter wide rolls and tested on a GEM superfinishing machine, model 04150-P. The workpiece used was a 1018 stainless steel solid roll having a diameter of 7.6 centimeters. The traverse rate of the abrasive article across the workpiece was 15.5 cm/minute, while the feed of unused abrasive article from the supply spool was 5 cm/minute. The dwell time of the abrasive article was the total finishing time. The back-up roll, or platen, behind the abrasive article was formed of rubber and had a 63 Shore A hardness, while the face pressure of the abrasive article onto the workpiece was 0.051 Pa. This platen was oscillated at an amplitude of 30% of maximum. Water was the coolant. Before each individual test, the steel workpiece was scuffed with a 60 micrometer IMFF to obtain a consistent initial surface finish. The surface finish and profile was obtained by using a profilometer, commercially available under the trade name Perthometer, and having a stylus tip which followed the contour of the surface, calculated the corresponding Ra, and produced a trace of the surface of the workpiece. The Ra values are reported in micrometers ($\mu$m).

Test Procedure 2

The method of Test Procedure 2 was the same as that of Test Procedure 1, except that the abrasive article was not indexed. For the duration of the test, the abrasive article was held stationery with no unused abrasive article being used to finish the workpiece. Unused abrasive tape was provided for each new workpiece.

In Table 1, Test Procedure 1 was used and the abrasive article was advanced 5 cm/min with a total dwell time of 30 seconds.

In Table 2, Test Procedure 1 was used and the abrasive article was advanced 5 cm/min with a total dwell time of 60 seconds.

TABLE 1

Test Procedure 1, Dwell 30 Seconds

| Example No. | Oscillation | Initial Ra | Final Ra |
|---|---|---|---|
| Comp. A | No | 0.33 | 0.46 |
| Comp. A | Yes | 0.33 | 0.15 |
| Comp. B | No | 0.33 | 0.51 |
| Comp. B | Yes | 0.25 | 0.15 |
| 1 | No | 0.36 | 0.30 |
| 1 | Yes | 0.30 | 0.25 |
| 2 | No | 0.36 | 0.51 |
| 2 | Yes | 0.33 | 0.15 |

TABLE 2

Test Procedure 1, Dwell 60 Seconds

| Example No. | Oscillation | Initial Ra | Final Ra |
|---|---|---|---|
| Comp. A | No | 0.33 | 0.56 |
| Comp. A | Yes | 0.36 | 0.23 |
| Comp. B | No | 0.28 | 0.51 |
| Comp. B | Yes | 0.33 | 0.13 |
| 1 | No | 0.28 | 0.46 |
| 1 | Yes | 0.30 | 0.36 |
| 2 | No | 0.30 | 0.51 |
| 2 | Yes | 0.36 | 0.15 |

The data in Tables 1 and 2 demonstrate that the process of this invention was useful in decreasing the Ra of the surface finish of the abraded workpiece.

Example 3

An abrasive article was made in the same manner as was used in Example 1, except that the slurry contained 69 parts WAO having an average particle size of 12 micrometers. The production tool had pyramidal-shaped cavities, each of which was about 180 micrometers in depth.

Comparative Example C

The abrasive article for Comparative Example C was a 12 micrometer aluminum oxide microfinishing film abrasive article, commercially available from Minnesota Mining and Manufacturing Company, St. Paul, Minn. under the trade designation "IMPERIAL" (hereinafter "IMFF").

Comparative Example D

The abrasive article for Comparative Example D was a 12 micrometer aluminum oxide lapping film abrasive article, commercially available from Minnesota Mining and Manufacturing Co., St. Paul, Minn. under the trade designation "IMPERIAL" (hereinafter "ILF").

Test Procedure 3

The method of Test Procedure 3 was the same as that of Test Procedure 1, except that the stainless steel workpiece was scuffed with a 100 micrometer IMFF to obtain a consistent initial surface finish.

Test Procedure 4

The method of Test Procedure 4 was the same as that of Test Procedure 2, except that the stainless steel workpiece was scuffed with a 100 micrometer IMFF to obtain a consistent surface finish, and a "pass" consisted of polishing with the abrasive article for 120 seconds.

In order to generate the data in tables 3 and 4, the initial surface finish was about 1 micrometer, as imparted by the 100 micrometer IMFF.

In Table 3, Test Procedure 3 was used to compare the surface finish provided by a structured abrasive article with a surface finish provided by a conventional abrasive article.

In Table 4, Test Procedure 4 was used to compare the useful life of the abrasive articles by running the abrasive article several times without indexing to provide fresh abrasive.

Figure 6:
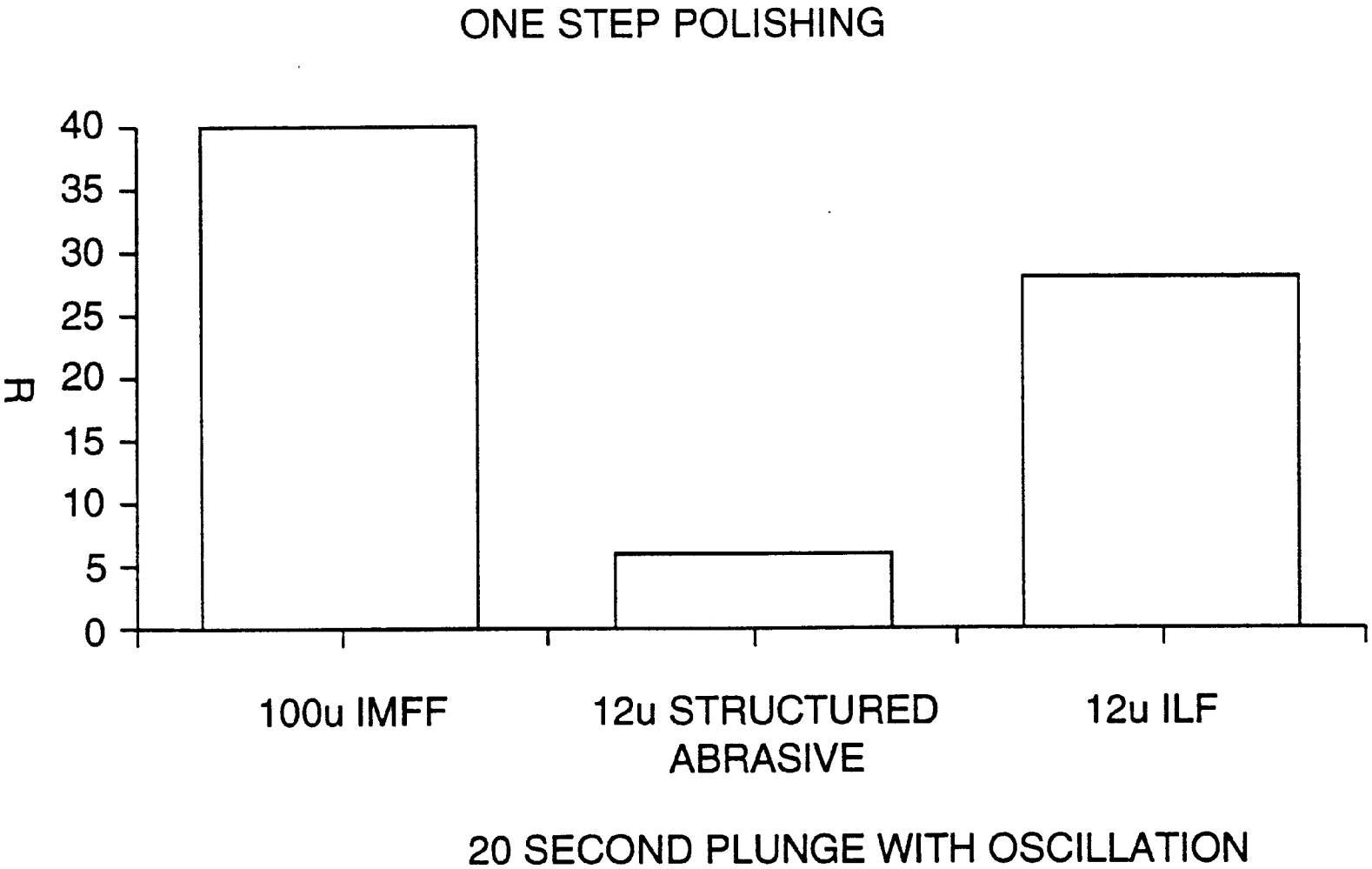
FIGS. 6 and 7 are graphical representations of the smooth finish that can be achieved by using the method of this invention.
Figure 7:
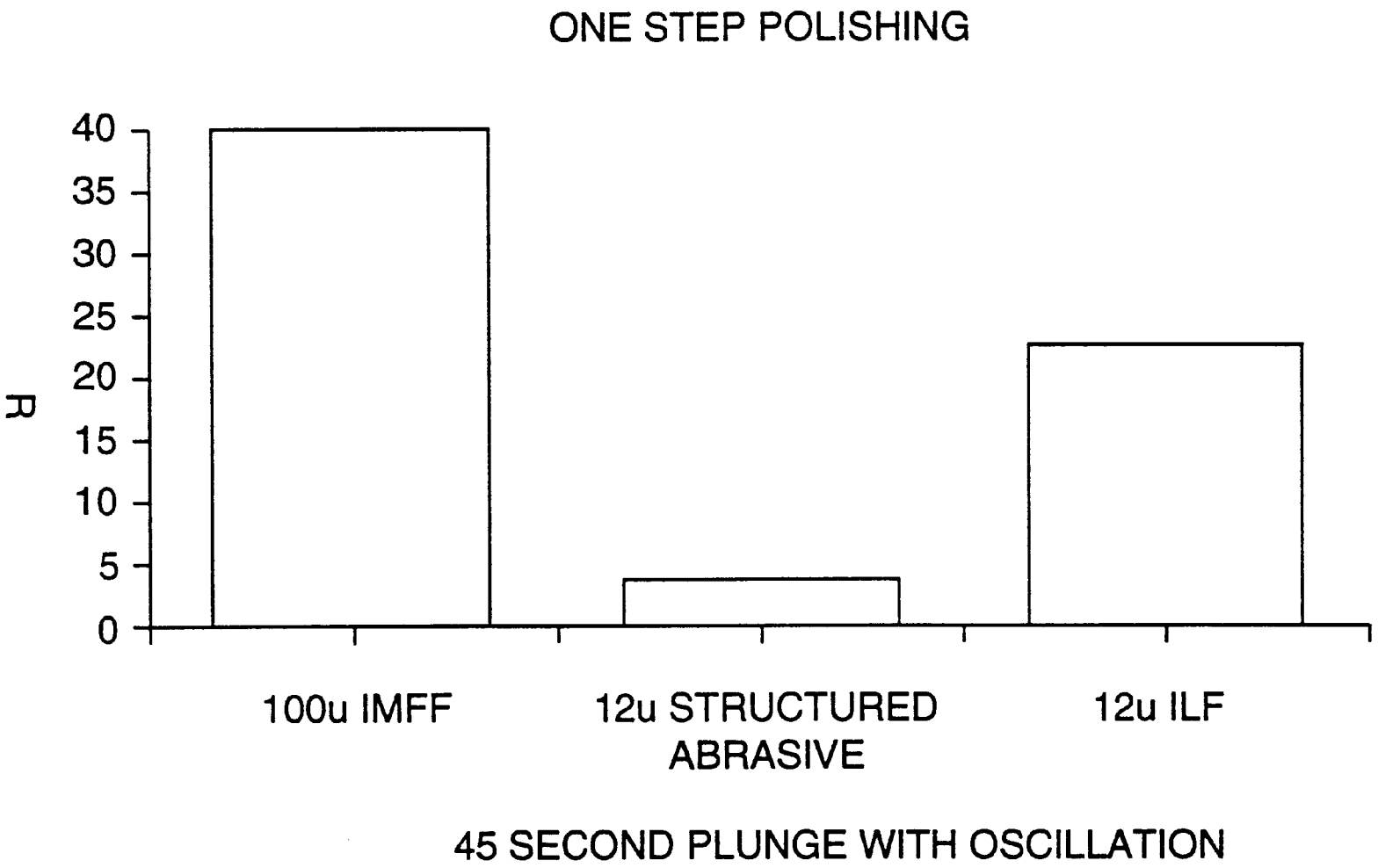

FIGS. 6 and 7 show the significant improvement in surface finish (reduced Ra) that can be achieved by using a structured abrasive article. FIG. 6 shows a comparison between the surface obtained in Example 3 and the surface obtained in Comparative Example D by means of Test Procedure 1 run for a duration of 20 seconds. FIG. 7 shows a comparison between surfaces obtained in Example 3 and Comparative Example D by means of Test Procedure 1 run for a duration of 45 seconds. Both FIGS. 6 and 7 show the surfaces of workpieces in the Working Examples reach a polished state more rapidly than do the workpieces in the Comparative Examples and achieve a better overall surface finish, as indicated by a smaller Ra.

TABLE 3

| | Ra (micrometers) | |
|---|---|---|
| Time (Sec) | Example 3 | Comparative Example C |
| 20 | 0.15 ± 0.03 | 0.70 ± 0.06 |
| 30 | 0.15 ± 0.03 | 0.65 ± 0.04 |
| 45 | 0.10 ± 0.01 | 0.58 ± 0.04 |
| 60 | 0.13 ± 0.03 | 0.60 ± 0.07 |
| 120 | 0.08 ± 0.02 | 0.48 ± 0.05 |

TABLE 4

| | Ra (micrometers) | |
|---|---|---|
| Passes | Example 3 | Comparative Example C |
| 1 | 0.10 ± 0.01 | 0.68 ± 0.08 |
| 2 | 0.13 ± 0.02 | 0.78 ± 0.06 |
| 3 | 0.13 ± 0.04 | 0.75 ± 0.08 |
| 4 | 0.15 ± 0.04 | 0.80 ± 0.04 |
| 5 | 0.15 ± 0.04 | 0.83 ± 0.09 |

The data in Table 3 shows that the structured abrasive article was able to reduce the surface finish Ra to about one-fifth of that produced by the abrasive article of Comparative Example C, even though both had the same abrasive grain size.

The data in Table 4 show that the surface finish produced by the structured abrasive article increased by only 0.05 micrometer (0.15 minus 0.10) after being used five times (five passes), whereas the surface finish produced by abrasive article of Comparative Example C increased by about 0.15 micrometer (0.83 minus 0.68). It would appear that in addition to eliminating steps, the structured abrasive article could be reused, thereby producing a cost savings.

It is possible to reduce the surface finish of the workpiece to a lower Ra value by means of a structured abrasive than with a conventional abrasive by the process of polishing with oscillation.

The specification, examples, and data provide a basis for understanding the invention. However, since many embodiments of the invention can be made without departing from the spirit and proper scope of the invention, the invention resides in the claims hereafter appended.

We claim:

1. A process for refining a surface of a workpiece comprising the steps of:

(a) placing a structured abrasive article in the form of a tape having a flexible backing and precisely shaped abrasive composites on at least one major surface thereof in contact with a workpiece having a surface having a scratch pattern having an initial Ra value thereon such that said precisely shaped abrasive composite bearing surface is in contact with said workpiece surface; each of said precisely shaped abrasive composites comprising abrasive grits distributed in a binder, wherein the cross-sectional area of at least a portion of said composites is greater at the backing than at the contact surface; and (b) after said initial Ra value is reduced, indexing said abrasive tape so to provide an unused abrasive surface of precisely shaped abrasive composites for use on a surface of a workpiece.

2. The process of claim 1 wherein said tape is indexed at a rate in a range of from about 0.01 cm/second to about 1 cm/second.

3. The process of claim 1, wherein said precisely shaped abrasive composites are pyramidal in shape.

4. A process for refining a surface of a workpiece comprising the steps of:

(a) placing a structured abrasive article in the form of a tape having a flexible backing and precisely shaped abrasive composites on at least one major surface thereof in contact with a workpiece having a surface having a scratch pattern having an initial Ra value thereon such that said precisely shaped abrasive composite bearing surface is in contact with said workpiece surface; each of said precisely shaped abrasive composites comprising abrasive grits distributed in a binder, wherein the cross-sectional area of at least a portion of said composites is greater at the backing than at the contact surface;

(b) rotating said workpiece about an axis of rotation in a first abrading direction while in contact with said structured abrasive article;

(c) simultaneously oscillating said structured abrasive article in a second abrading direction while in contact with said workpiece, said second abrading direction not being parallel to said first abrading direction such that said second abrading direction crosses said first abrading direction while contact is maintained between the composite bearing surface and said workpiece surface to expose unworn abrasive grit for contact with said workpiece at leading edges of said precisely shaped abrasive composites; and (d) after said initial Ra is reduced, indexing said abrasive tape so to provide an unused abrasive surface of precisely shaped abrasive composites for use on a surface of a workpiece, whereby the process is capable of reducing an initial Ra value of about 1 micrometer on a 1018 stainless steel solid roll to an Ra of about 0.15 in about 20 seconds.

5. The process of claim 4 wherein the process is capable of reducing an initial Ra value of about 1 micrometer on a 1018 stainless steel solid roll to an Ra of about 0.08 in about 120 seconds.

6. A process for refining a surface of a workpiece comprising the steps of:

(a) placing a structured abrasive article in the form of a tape having a flexible backing and precisely shaped abrasive composites on at least one major surface thereof in contact with a workpiece having a surface having a scratch pattern having an initial Ra value thereon such that said precisely shaped abrasive composite bearing surface is in contact with said workpiece surface; each of said precisely shaped abrasive composites comprising abrasive grits distributed in a binder, wherein the cross-sectional area of at least a portion of said composites is greater at the backing than at the contact surface;

(b) rotating said workpiece about an axis of rotation in a first abrading direction while in contact with said structured abrasive article;

(c) simultaneously oscillating said structured abrasive article in a second abrading direction while in contact with said workpiece, said second abrading direction not being parallel to said first abrading direction such that said second abrading direction crosses said first abrading direction while contact is maintained between the composite bearing surface and said workpiece surface to expose unworn abrasive grit for contact with said workpiece at leading edges of said precisely shaped abrasive composites; and (d) after said initial Ra is reduced, indexing said abrasive tape so to provide an unused abrasive surface of precisely shaped abrasive composites for use on a surface of a workpiece, whereby the process is capable of reducing an initial Ra value of about 1 micrometer on a 1018 stainless steel solid roll to an Ra of about 0.10 in one pass of about 120 seconds.

7. The process of claim 6 wherein the process is capable of producing an Ra of about 0.15 on a 1018 stainless steel solid roll after three additional passes of about 120 seconds.

8. The process of claim 1 further including the steps of:

(c) rotating said workpiece about an axis of rotation in a first abrading direction while in contact with said structured abrasive article; and (d) simultaneously oscillating said structured abrasive article in a second abrading direction while in contact with said workpiece, said second abrading direction not being parallel to said first abrading direction such that said second abrading direction crosses said first abrading direction while contact is maintained between the composite bearing surface and said workpiece surface to expose unworn abrasive grit for contact with said workpiece at leading edges of said precisely shaped abrasive composites.

9. The process of claim 1 wherein said pressure contact is less than about 700 kPa.

10. The process of claim 8 wherein said non-parallel movement has an amplitude of about 0.01 cm to about 15 cm.

11. The process of claim 1 wherein said workpiece comprises a cylindrical article.

12. The method of claim 8 wherein said non-parallel movement has a frequency of about 1 to about 100 oscillations per minute.

13. The process of claim 1 wherein the structured abrasive article comprises abrasives composites having the shape of a cone or pyramid, the height of said cone or said pyramid being from about 50 to about 350 micrometers.

14. The process of claim 13 wherein said workpiece is in the shape of a lobe.

15. The process of claim 1 wherein said initial Ra value is less than about 20 micrometers and is reduced to a value of less than about 2 micrometers.

16. The process of claim 8 wherein said second abrading direction is perpendicular to said first abrading direction.

17. The process of claim 1, wherein said contact maintained between said composite bearing surface and said workpiece surface provides an interface therebetween, and further comprising introducing a liquid coolant at said interface.

18. The process of claim 1, wherein said workpiece is selected from the group consisting of lenses, journals, crankshafts, camshafts, crankpins, coating rolls, and printing rolls.

19. The process of claim 1, wherein said backing comprises a polymeric film.

* * * * *

UNITED STATES PATENT AND TRADEMARK OFFICE

CERTIFICATE OF CORRECTION

PATENT NO. : 5,913,716
DATED : June 22, 1999
INVENTOR(S) : Michael V. Mucci and Richard M. Olson It is certified that error appears in the above-identified patent and that said Letters Patent is hereby corrected as shown below:

Title page,
Under OTHER PUBLICATIONS, insert -- Brochure I: GEM CENTERLESS MICROFINISHERS, published before January 1, 1990 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*